US005139660A

United States Patent [19]

Lourie et al.

[11] Patent Number: 5,139,660

[45] Date of Patent: Aug. 18, 1992

[54] SWIMMING POOL SKIMMER

[76] Inventors: Neal M. Lourie, c/o Isadore E. Lourie, Esq., P.O. Box 12089, Columbia, S.C. 29211; George W. Autry, 900 Davis Dr., Columbia, S.C. 29223; Herman D. Smith, 127 Yorkshire Dr., Lugoff, S.C. 29078

[21] Appl. No.: 691,560

[22] Filed: Apr. 25, 1991

[51] Int. Cl.[5] ..... E04H 4/16

[52] U.S. Cl. ..... 210/169; 210/238; 210/470; 15/1.7; 4/490; 4/496

[58] Field of Search ..... 210/169, 238, 237, 470; 15/1.7; 43/9.1, 11, 14; 4/490, 494, 496

[56] References Cited

U.S. PATENT DOCUMENTS

| | | | |
|---|---|---|---|
| 2,203,827 | 6/1940 | Kors | 43/14 |
| 2,367,997 | 1/1945 | Chambers | 210/169 |
| 2,553,980 | 5/1951 | Ostrander | 43/14 |
| 3,699,700 | 10/1972 | Kinsell | 43/14 |
| 3,863,237 | 1/1975 | Doerr | 210/169 |
| 4,053,412 | 10/1977 | Stix | 210/169 |
| 4,089,074 | 5/1978 | Sermons | 210/169 |
| 4,472,842 | 9/1984 | Jarrett | 210/169 |
| 4,509,285 | 4/1985 | Smith | 43/9 |
| 4,518,495 | 5/1985 | Harding | 210/169 |
| 4,557,001 | 12/1985 | Burkhart | 210/169 |
| 4,822,487 | 4/1989 | Soich | 210/238 |
| 4,888,842 | 12/1989 | McKamey et al. | 15/1.7 |
| 5,043,060 | 8/1991 | Brennan | 210/169 |
| 5,085,767 | 2/1992 | Beers | 210/169 |

*Primary Examiner*—Peter Hruskoci
*Assistant Examiner*—Robert James Popovics
*Attorney, Agent, or Firm*—Michael A. Mann

[57] ABSTRACT

A pool skimmer for removing debris from the surface of a pool. The skimmer comprises a frame and netting and spans the width of the pool. The frame further comprises two handles and upper and lower members offset by two arms supported by the handles. The netting is provided in excess so that it billows out and follows the frame when the frame is moved from one end of the pool to the other. The upper and lower members further comprise sections that telescope so that the skimmer can accomodate pools of different widths and contours.

16 Claims, 3 Drawing Sheets

18
20
12
10
14
108
16
58
18'
54
52
50
30

10
32
14
34
54
50
30

10
36
32
38
34
A
14

SWIMMING POOL SKIMMER

BACKGROUND OF THE INVENTION

1. Field of the Invention

The present invention relates to swimming pool skimmers, and in particular to devices for skimming floating debris and insects from the surface of the water in a swimming pool.

2. Discussion of Background

The surface of the water of an outdoor swimming pool receives a variety of air-borne debris, such as leaves, twigs, pine straw, and insects. Periodic skimming of the debris is required not only to keep the pool surface clean and appealing but also to prevent the debris from clogging the pool's filtration equipment.

The typical skimmer comprises a bit of netting stretched across a frame mounted to the end of a long pole. The pole is used to maneuver the frame around the pool surface to pick up the debris wherever it may be floating. This process is time consuming.

Other skimmers exist that make the task of skimming debris from a pool surface somewhat easier. Sermons, in U.S. Pat. No. 4,089,074, discloses a skimmer that is placed near the pool outflow to skim debris as the surface water is drawn to the outflow. However, this passive approach to pool skimming also requires time to collect the debris. Burkhart and Jarrett (U.S. Pat. Nos. 4,557,001 and 4,472,842, respectively) describe active, flexible devices that are maneuvered over the pool surface. However, flexible devices are difficult to remove from a pool without spilling the debris that has been gathered back into the water. Finally, Chambers describes in U.S. Pat. No. 2,367,997, a rigid frame, to which is attached a cloth and that extends from one side of the pool to the other to sweep the surface for debris and insects.

None of these devices provides effective removal of debris and insects. Pools vary in size and shape and have features such as ladders and diving boards, the dimensional variations of which must be accommodated by a pool skimmer without loss of full-width skimming for efficiency. None of the above-described devices will trap the debris effectively so that it can be removed from the pool easily and completely. There remains a need for an effective, full-width pool skimmer.

SUMMARY OF THE INVENTION

According to its major aspects and broadly stated, the present invention is a swimming pool skimmer comprising a rigid frame with netting attached to the frame. The netting is provided in sufficient excess so that it blouses when the frame is lifted and follows the frame when the frame is pulled through the water.

The frame has two handles and an upper and a lower member supported by the two handles. The upper and lower members are formed of at least two first sections, each having a first diameter, and two second sections, each having a second, smaller diameter, so that the second sections can slide into the first sections to enable the skimmer to accommodate different pool widths. The upper and lower members have drain holes to allow any water that enters the frame to drain back out. The members are off-set from the handles by an upper arm, extending at approximately a 90° angle from the vertical, and a lower arm, extending at an angle less than 90°, in order to allow the skimmer to be easily maneuvered under diving boards and the like. The two handles are formed of vertical portions that are dipped part way into the water, horizontal portions near the top of the vertical portions, and hand grip portions attached to the horizontal portions. Thus, the hand grip portions are not directly over the vertical portions, but rather offset by the horizontal portions to make it easier to stand on the side of the pool and move the skimmer.

The excess netting is an important feature of the present invention. By providing excess netting, more debris can be captured and held better than by netting that is stretched across a frame or in scant excess. As the skimmer is moved through the pool, debris is gathered against the netting which follows the frame. When the skimmer is stopped, the netting sinks downward, behind the frame, trapping the debris and holding it securely as the skimmer is lifted from the pool. On the first pass, the skimmer will remove the debris from the surface of the water.

Another feature of the present invention is the telescoping of the second section of the frame into the first section. This feature allows various sizes of pools and various shapes of pools to be accommodated by one design. Many pools are zoned for diving at one end and for laps at another. These zones may have different widths. The present skimmer is made to easily adjust to a wide range of pool widths and contours.

Still another feature of the present invention is the sectioned frame, allowing the skimmer to be taken apart for storage.

Holding the netting in an offset by the upper and lower arms is another important feature of the present invention. Reaching the skimmer under a diving board, for example would be much more difficult without the offset, especially without the angled offset provided by the lower arm, which enables the lower member to be maneuvered under the diving board before dipping the frame into the water.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figures 1, 2, 3:
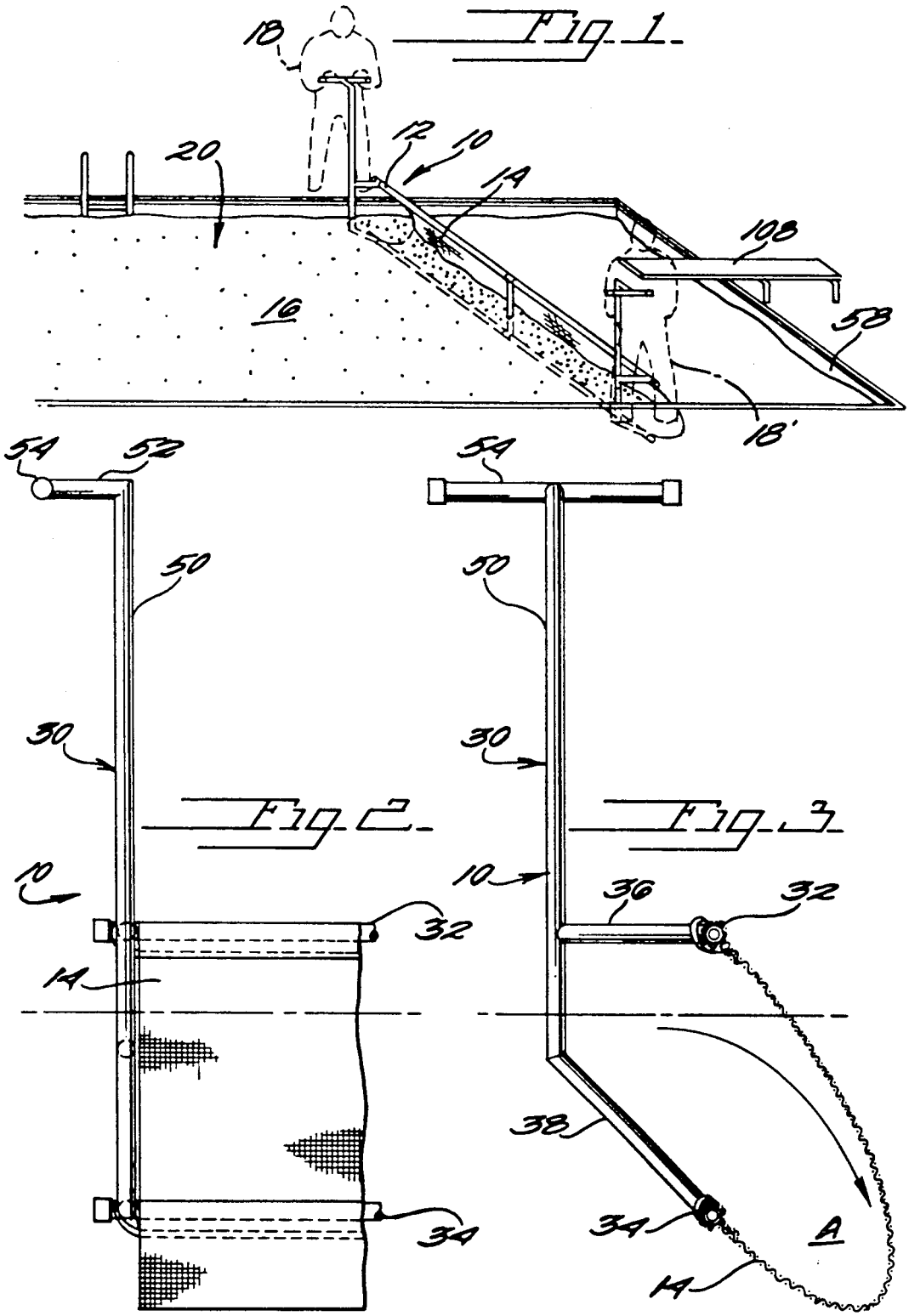
FIG. 1 is a perspective view of a pool skimmer according to a preferred embodiment of the present invention in use in a pool.
FIG. 2 is a front view of a portion of the pool skimmer shown in FIG. 1.
FIG. 3 is a side view of the pool skimmer shown in FIG. 1.

Referring now to FIG. 1, there is illustrated a pool skimmer 10 according to a preferred embodiment of the present invention. Pool skimmer 10 generally comprises a frame 12 and netting 14 carried by frame 12. Pool skimmer 10 is designed to be extended across a pool 16 and moved along the sides of pool 16, from one end of pool 16 to the other by a person 18, 18' at each end. As skimmer 10 is moved it picks up debris from the surface 20 of pool 16 leaving surface 20 clear behind skimmer 10.

The general features of frame 12 are shown in FIGS. 2-4 and 8. As best seen in FIG. 2, frame 12 comprises a handle 30, 30' at each end, an upper member 32 and a lower member 34 supported from each handle 30, 30'. Members 32, 34 are offset from handles 30, 30' by an upper arm 36, 36' and a lower arm 38, 38' (FIG. 3). Upper arm 36, 36' preferably is at right angles to handles 30, 30'; lower arm 38, 38' preferably extends from handles 30, 30' at an angle of about 45°, a little more or a little less. The ends of upper and lower arms, 36, 36', 38, 38' extend far enough so that upper member 32 is generally over lower member 34.

Figure 4:
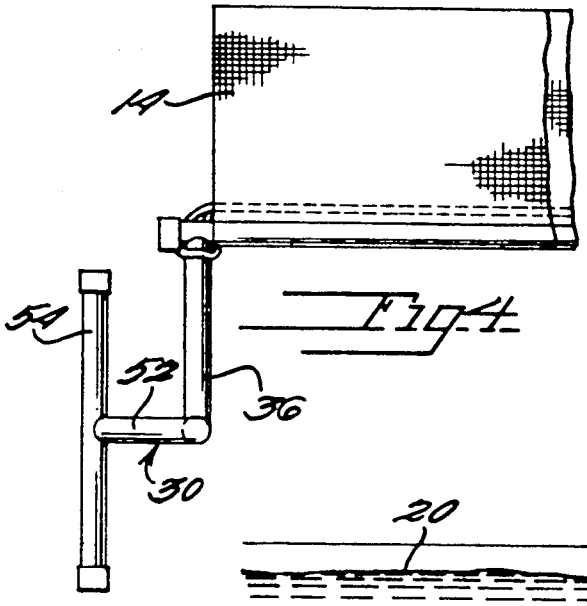
FIG. 4 is a top view of a portion of the the pool skimmer of FIG. 1.
Figure 8:
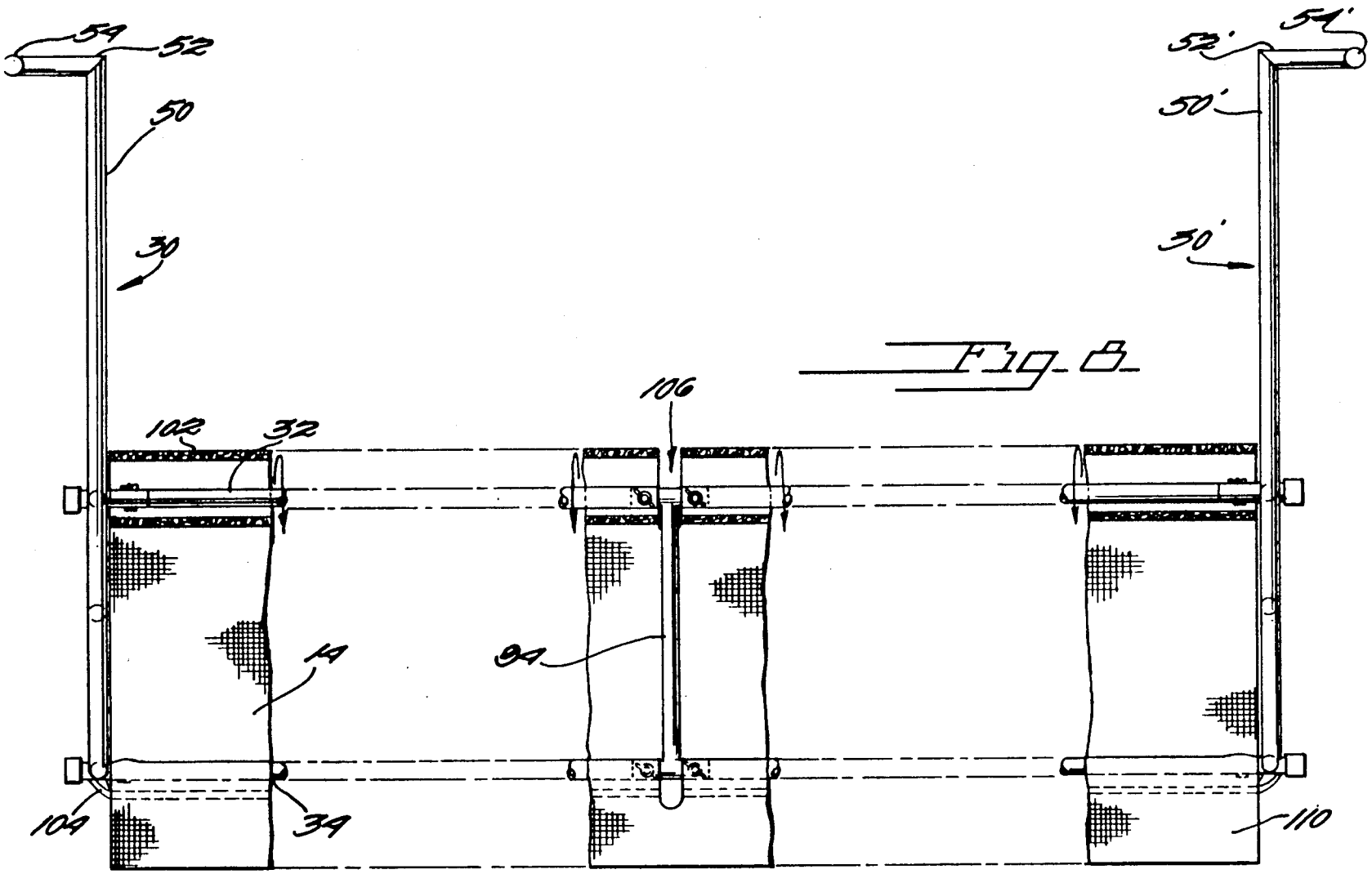
FIG. 8 is a front view of the pool skimmer according to a preferred embodiment of the present invention.

As seen in FIGS. 3, 4 and 8, attached to upper member 32 and lower member 34 is netting 14. Netting 14 is provided in excess of that needed to span the distance between upper member 32 and lower member 34 by a factor of at least 50% and preferably 150%. When frame 12 is pulled through pool 16, netting 14 will billow to form a region A and follow frame 12. Debris strained from the pool water by netting 14 will be trapped. When frame 12 stops moving, instead of the debris sinking or rising to the surface or being carried off netting 14 by momentum, the netting moves forward and sags, holding the debris in region A, where it will remain until removal, trapped in the fold of netting 14.

As shown in FIGS. 3, 4, and 8, handle 30, 30' has a vertical portion 50, 50', a horizontal portion 52, 52', and hand grip portion 54, 54'. Horizontal portion 52, 52' connects hand grip portion 54, 54' with vertical portion 50, 50'. Vertical portion carries upper and lower arms 36, 36', 38, 38'. Hand grip portion 54, 54' is formed for two-hand operation so that frame 12 can be oriented as needed for sweeping and insertion into pool 16.

Figure 5:
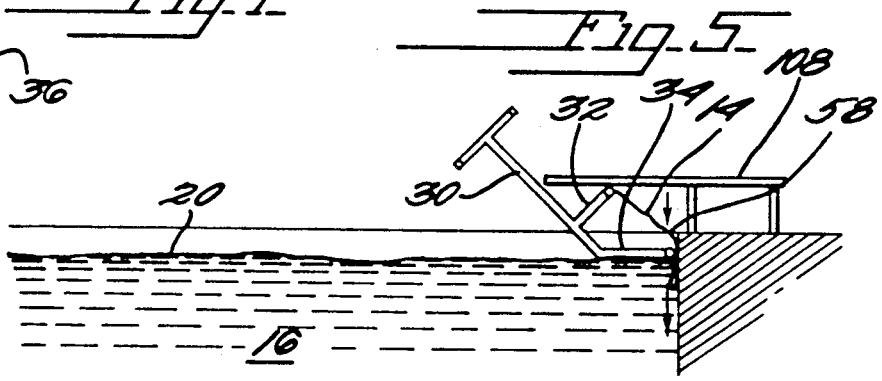
FIG. 5 is a side view of the pool skimmer of FIG. 1 at the end of the pool partially under a diving board.

As best seen in FIG. 5, for starting pool skimmer 10, frame 12 moved one end of pool 16 and lower member 34 is placed on the surface 20 of water against a pool side 58 by tilting frame 12. The lower member is dipped below surface 20 but upper member 32 is held above surface 20. Then skimmer 10 is moved away from side 58 to the opposite side of pool 16.

Figure 6:
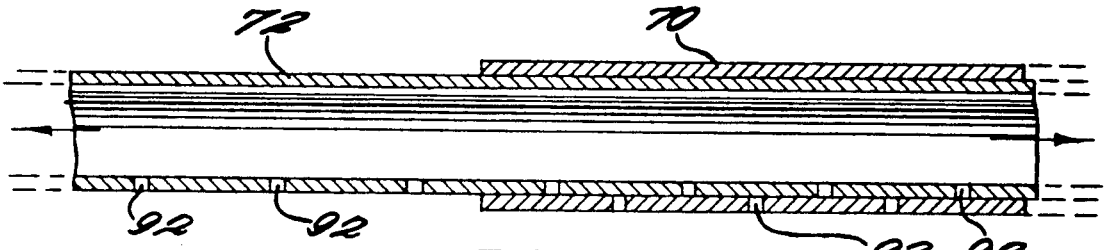
FIG. 6 is a detailed cross-sectional view of the first and second sections of the frame according to a preferred embodiment of the present invention.
Figure 7:
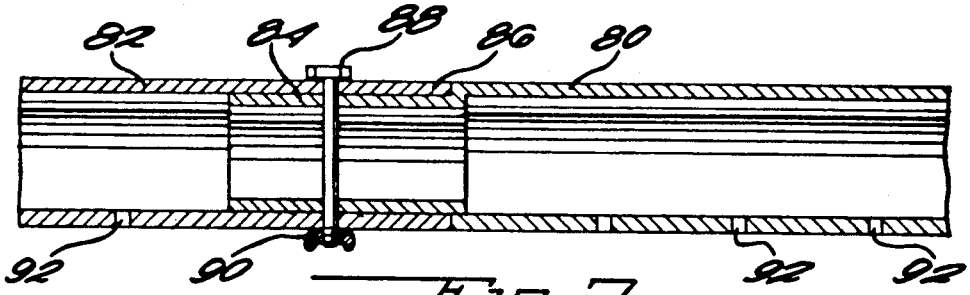
FIG. 7 is a detailed cross-sectional view of the joining of the two first sections of the frame according to a preferred embodiment of the present invention.

Preferably skimmer 10 is made in sections and adjusts to different widths. As illustrated in FIGS. 6, 7, and 8, upper member 32 and lower member 34 are composed of one or more sections. There is at least one first section 70 and at least one second section 72. As best seen in FIG. 6, first section 70 has a slightly larger diameter than second section 72 so that second section 72 can slide into first section telescopically. The width of frame 12 can then be adjusted to accommodate different sized pools and variations in the width of a given pool by simply sliding second section 72 into first second 70 by applying pressure on handles 30, 30' directed parallel to upper and lower members 32, 34. Preferably, there is one second section 72 at each end of first section 70 for maximum adjustability.

First section 70 is preferably made of more than one interconnected subsection so that frame may be dismantled for winter storage or shipping. As seen in FIG. 7, a subsection 80 is joined to a subsection 82. An end 84 of subsection 80 has a reduced diameter and is inserted into an end 86 of subsection 82 and the two ends fastened by a bolt 88 and wing nut 90 or other attachment device.

First section 70 and second section 72 of both upper and lower members 32, 34, respectively, have a plurality of drain holes 92 to allow water that enters frame 12 to drain when frame 12 is pulled clear of pool 16.

If more than one first section 70 is used, it is best to provide an center support 94 (FIG. 8) to stiffen frame 12 and maintain the distance between upper member 32 and lower member 34. Support 94 is connected to the ends of first sections 70.

As shown in FIG. 8, netting 14 is fastened to upper and lower members 32, 34 preferably by strips 102, 104 of VELCRO running the length of frame 12, except for a cutout portion 106 at center support 94 that fold onto each other. FIG. 8 shows a portion of netting unfolded along upper member 32. Preferably strips 102, 104 loop around vertical members 50, 50' so netting 14 is held in position better.

In use, pool skimmer 10 is taken to one end of pool 16, preferably the end with a diving board if pool 16 has a diving board 108, as in FIG. 5, and rotated about 45° so that lower member 34 is against side 58 and just above surface 20 of pool 16. Then lower member 34 is dipped into pool 16 below surface 20 but not so far that upper member 32 is below surface 20. Then skimmer 10 is returned to the vertical position and moved to the far end of pool 16. During the traversing of pool 16, netting will billow behind and follow frame 12, catching debris in region A (FIG. 3) and holding it. At the far end, skimmer is raised straight up and held for a moment or two to allow any water that entered frame 12 to drain through drain holes 92. Netting 14 will hang in such a way that the debris is held in a fold 110 (FIG. 8) of the excess netting material. After skimmer is moved free of pool 16, the netting can be cleaned by shaking it and backflushing it with a hose.

It will be apparent to those skilled in the art that many changes and substitutions can be made to the preferred embodiment herein described without departing from the spirit and scope of the present invention which is defined by the appended claims.

What is claimed is:

1. A swimming pool skimmer for removing debris and insects from the surface of water in a swimming pool, said skimmer comprising:

a frame having two handles, each of said handles having an axis, upper arms extending from said handles, lower arms extending from said handles, an upper member extending between said upper arms, and a lower member extending between said lower arms, said lower arms extending at an angle less than 90° with respect to the axis of said handles;

netting attached to upper and lower members of said frame, said netting provided in excess so that said netting blouses from said frame and follows said frame when said frame is dipped into said water and moved laterally.

2. The skimmer as recited in claim 1, wherein said frame further comprises:

a first section having a first diameter; and a second section having a second diameter, said second diameter being smaller than said first diameter, said second section slidably received within said first section.

3. The skimmer as recited in claim 1, wherein said frame holds said netting offset from said handles.

4. The skimmer as recited in claim 1, wherein said frame further comprises:

a first section having a first diameter, a second section having a second diameter, said second diameter being smaller than said first diameter, said second section slidably received within said first section; and arms extending from said handles so that said netting is held off set from said handles.

5. The skimmer as recited in claim 1, wherein said frame further comprises:

a first section having a first diameter, said first section being composed of at least two interconnecting subsections, said first section having a first end and a second end;

two second sections each of which has a second diameter, said second diameter being smaller than said first diameter of said first section, one of said second sections slidably received within said first end of said first section and another of said second section sections slidably received with said second end of said first section.

6. The skimmer as recited in claim 1, wherein said upper arms extend at an angle of approximately 90° so that said netting is held offset of said handles.

7. The skimmer as recited in claim 1, wherein said handles further comprise:

vertical portions;

horizontal portions connected to said vertical portions; and hand grip portions, said hand grip portions attached to said horizontal portions so that said hand grip portions are laterally off set from said vertical portions.

8. A swimming pool skimmer for removing debris and insects from the surface of water in a swimming pool, said skimmer comprising:

a frame having two handles, each of said handles having an axis, a first section connected to said two handles and having a first diameter, and a second section connected to said two handles and having a second diameter, said second diameter being smaller than said first diameter, said second section slidably received within said first section upper arms extending from said handles, lower arms extending from said handles, an upper member extending between said upper arms, and a lower member extending between said lower arms, said lower arms extending at an angle less than 90° with respect to the axis of said handles; said netting attached to said upper and lower members of said frame.

9. The skimmer as recited in claim 8, wherein said upper arms extend at an angle of approximately 90° so that said netting is held offset of said handles.

10. The skimmer as recited in claim 8, wherein said handles further comprise:

vertical portions;

horizontal portions connected to said vertical portions; and hand grip portions, said hand grip portions attached to said horizontal portions so that said hand grip portions are laterally off set from said vertical portions.

11. The skimmer as recited in claim 8, wherein said first section is composed of at least two interconnecting subsections.

12. A swimming pool skimmer for removing debris and insects from the surface of water in a swimming pool, said skimmer comprising:

a frame having two handles, each of said handles having an axis, a first section connected to said two handles and having a first diameter, and a second section connected to said two handles and having a second diameter, said second diameter being smaller than said first diameter, said second section slidably received within said first section said second section formed of at least two interconnected subsections, upper arms extending from said handles, lower arms extending from said handles;

an upper member extending between said upper arms, said upper member formed of said at least two first sections and two second sections; and a lower member extending between the said lower arms, said lower member formed of said at least two first sections and two second sections, said lower arms extending at an angle less than 90° with respect to the axis of said handles; and netting attached to said upper and said lower members of said frame, said netting provided in excess so that said netting blouses from said frame and follows said frame when said frame is dipped into said water and moved laterally.

13. The skimmer as recited in claim 12, wherein said upper arms extend at an angle of approximately 90° so that said netting is held offset of said handles.

14. The skimmer as recited in claim 13, wherein said handles further comprise:

vertical portions;

horizontal portions connected to said vertical portions; and hand grip portions, said hand grip portions attached to said horizontal portions so that said hand grip portions are laterally off set from said vertical portions.

15. The skimmer as recited in claim 14, wherein said lower member has a plurality of drain holes to release any water that enters said lower member.

16. The skimmer as recited in claim 15, further comprising means for releasibly attaching said netting to said upper member, said lower member, and said vertical members.

* * * * *